US006430829B1

(12) United States Patent
Williamson et al.

(10) Patent No.: US 6,430,829 B1
(45) Date of Patent: Aug. 13, 2002

(54) LOFT AND LIE GAUGE FOR GOLF CLUBS

(75) Inventors: Richard J. Williamson, Scottsdale; Mitchell E. Bac, Glendale, both of AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 09/495,254

(22) Filed: Jan. 31, 2000

(51) Int. Cl.[7] ..... G01B 1/00; G01B 3/56
(52) U.S. Cl. ..... 33/508; 33/534
(58) Field of Search ..... 33/508, 1 N, 465, 33/471, 534; 473/282, 287, 290, 109; 73/65.01, 65.03, 65.07, 65.08

(56) References Cited

U.S. PATENT DOCUMENTS

| | | | | | |
|---|---|---|---|---|---|
| 2,546,426 | A | * | 3/1951 | Bryant | 33/508 |
| 2,973,581 | A | * | 3/1961 | Rhodehamel | 33/508 |
| 3,293,762 | A | * | 12/1966 | Solheim | 33/508 |
| 3,439,429 | A | * | 4/1969 | Sundstrom | 33/508 |
| 3,822,477 | A | | 7/1974 | Collins | |
| 4,094,072 | A | * | 6/1978 | Erb | 33/174 F |
| 4,245,391 | A | * | 1/1981 | Heller | 33/174 F |
| 4,549,357 | A | * | 10/1985 | Hirose | 33/508 |
| 4,620,431 | A | * | 11/1986 | Muldoon | 72/31 |
| 4,640,017 | A | * | 2/1987 | Cukon | 33/508 |
| 4,655,457 | A | | 4/1987 | Thompson | 273/162 |
| 4,817,294 | A | | 4/1989 | Lai | |
| 4,858,332 | A | | 8/1989 | Thomas | |
| 4,875,293 | A | * | 10/1989 | Wakefield | 33/508 |
| 4,928,397 | A | * | 5/1990 | Wang | 33/508 |
| 4,934,706 | A | | 6/1990 | Marshall | 273/183 |
| 5,105,550 | A | | 4/1992 | Shenoha | |
| 5,327,766 | A | * | 7/1994 | Humphreys | 33/508 |
| 5,421,098 | A | | 6/1995 | Muldoon | 33/508 |
| 5,884,409 | A | * | 3/1999 | Muldoon | 33/508 |

FOREIGN PATENT DOCUMENTS

| | | | | | |
|---|---|---|---|---|---|
| JP | 61040501 | | | 2/1986 | |
| JP | 02193001 | A | * | 7/1990 | 33/508 |
| JP | 08086603 | A | * | 4/1996 | G01B/5/24 |

* cited by examiner

*Primary Examiner*—Diego Gutierrez
*Assistant Examiner*—Mirellys Jagan
(74) *Attorney, Agent, or Firm*—Darrell F. Marquette

(57) ABSTRACT

A gauge for measuring the loft and lie angles of a golf club includes a rod attachable to the golf club with a first pointer mechanism being in alignment with the shaft axis of the golf club. A body is rotatable about the rod into parallel alignment with the sole of the golf club and a first indicator plate is movable with the body and relative to the first pointer mechanism to provide a visual indication of the lie angle of the golf club by showing the angle of rotation of the indicator plate relative to the first pointer mechanism. A face engaging member is pivotally mounted on the body for movement into engagement with the face of the golf club, and a second pointer mechanism is movable with the face engaging member relative to a second indicator plate carried on the body to provide a visual indication of the loft angle of the golf club by showing the angle of rotation of the second pointer mechanism relative to the second indicator plate.

10 Claims, 5 Drawing Sheets

LOFT AND LIE GAUGE FOR GOLF CLUBS

BACKGROUND OF THE INVENTION

This invention relates in general to measuring instruments and more particularly to a hand gauge for measuring loft and lie angles of golf clubs.

Fitting golf clubs to an individual golfer includes the consideration of several factors such as grip size, shaft length, swing weight and, of particular importance, loft and lie angular relationships of the golf clubs.

The loft angle of a golf club is the angle between a ball striking face of a club head and a plane that includes the golf club shaft axis and is disposed parallel to the lower edge of the face of the club head. Golf clubs having small loft angles are used for low trajectory-long flight golf shots, and golf clubs with large loft angles are for higher trajectory-shorter flight golf shots. The particular loft angle for each club in a set of golf clubs is not regulated by any standards or non-variable factors. Instead, the loft angles are normally predetermined by the designer of the clubs to achieve the desired performance characteristics for each club. During manufacture (and subsequent adjustments if accomplished) the loft angles of the clubs are checked and adjusted by bending the clubs as needed to bring them into conformity with the manufacturers predetermined angular values or to satisfy special requests that a golfer may make.

The lie angle is the angle between the shaft axis and a line tangent to the center point on the sole of the club head. If the lie angle is too small for a particular golfer, the club head will be angled upwardly as it impacts a golf ball, and the flight of the golf ball will be toward the left of the intended flight path. Similarly, if the lie angle is too large for a particular golfer, the club head will be angled downwardly as it impacts a golf ball and the flight of the golf ball will be toward the right of the intended flight path. The correct lie angle for an individual golfer is ideally determined by a trained fitting specialist, such as a PGA professional, who watches the golfers swing and can determine the correct lie angle by observing, among other things, the flight of the golf ball.

With properly fitted golf clubs, an individual golfer should be able to achieve optimum performance and shot reliability in accordance with his or her skill level. However, golf clubs can accidently be knocked out of adjustment and/or the golfer's swing characteristics can change. When this occurs, the golfer's performance level will deteriorate and in many instances, the golfer will not realize that the golf clubs are at fault. Therefore the loft and lie angles of golf clubs should be periodically checked and adjustments made if needed.

When checking or making changes in the loft and lie angles of golf clubs either at the time of manufacture or during subsequent adjustments, the clubs are usually placed one at a time in a special holding fixture that is part of a bench mounted measuring and adjustment mechanism. Such mechanisms usually make accurate measurements and provide visual indications of the loft and lie angles of the club being held in the fixture. With the club still in the holding fixture, special tools are used to bend the club head into the desired angular relationships. However, such bench mounted measuring and adjustment mechanisms cannot be considered portable and only manufacturing or large well-equipped golf shops can justify the cost or dedicate the space required by these mechanisms.

U.S. Pat. No. 4,934,706 issued to Marshall on Jun. 19, 1990 discloses a device which is described as a training aid rather than a gauge for measuring the angular relationships of golf clubs. The device is for mounting on a golf club shaft adjacent the grip and uses two bubble levels to indicate the lie angle and vertical disposition of the golf club as is being held in the address position by a golfer.

U.S. Pat. No. 5,421,098 issued to Muldoon on Jun. 6, 1995 discloses a device similar to the Marshall structure discussed above. The device is mounted part way up on the golf club shaft and employs two bubble levels to indicate the loft and lie angles preferred by the golfer while holding the golf club in the address position.

Both of these prior art devices require that a golfer be holding the golf club in the address position and they use the bubble levels to indicate the position in which the club is being held. These devices measure the loft and lie angles at which the golfer is holding the club rather than the actual angular relationships of the golf clubs. Therefore, a need exists for a new gauge for measuring the loft and lie angles of golf clubs.

SUMMARY OF THE INVENTION

In accordance with the present invention, a gauge for measuring loft and lie angles of golf clubs is disclosed. The gauge includes a body having a handle in which a rod is mounted for rotational and axial movements relative to the body. A clamp for gripping a hosel of a golf club head is carried on an inner end of the rod. A first indicia assembly is mounted on the body and on the rod to provide a visual indication of the angular relationship between the body and the rod. The angular relationship between the rod and the body, as indicated by the first indicia assembly, is the lie angle of the golf club being measured.

A face engaging member in the form of a plate is carried on the gauge body and is rotationally and axially movable therewith relative to the rod. The plate is also pivotally movable relative to the body into engagement with a ball striking face of the golf club to be measured. A second indicia assembly is mounted on the plate and on the gauge body to provide a visual indication of the pivotal position of the plate. The pivotal position of the plate, as indicated by the second indicia assembly, is the loft angle of the golf club being measured.

To measure the loft and lie angles of a golf club, the gauge is attached to the golf club by the clamp which grips the hosel of the club head. This places the handle of the gauge body, and the rod carried therein, in a normally extending position relative to the hosel axis and the shaft axis of the golf club. The clamp is configured so that the rod and the entire gauge can be rotated about the shaft axis of the golf club. Such movement is employed to bring the face of the golf club head into parallel relationship with the pivot axis of the face engaging plate. Axial movement of the handle along the axis of the rod is used to move the gauge body toward the golf club to bring the plate into engagement with the face of the club head. The plate is then pivotably moved about its pivot axis to bring it into contiguous engagement with the face of the club, and when so positioned, the second indicia assembly will display the loft angle of the golf club.

As is customary, grooves are provided on the faces of golf club heads and they are parallel to a line that is tangent to a center point on the sole of the club head. Rotational movements of the gauge body about the rod axis are used to bring an edge of the plate into parallel alignment with those grooves. Such movements will bring a laterally extending portion of the gauge body into precise parallel alignment with this tangent line. The clamp carried on the rod holds the rod so that a portion of the first indicia assembly mounted thereon will be indicative of the relative position of the golf club shaft axis. With the gauge body being in alignment with the tangent line and the rod being indicative of the shaft axis position, the angular relationship between the rod and the body, as indicated by the first indicia assembly, will be the lie angle of the golf club.

DESCRIPTION OF THE PREFERRED EMBODIMENT

Figure 5A:
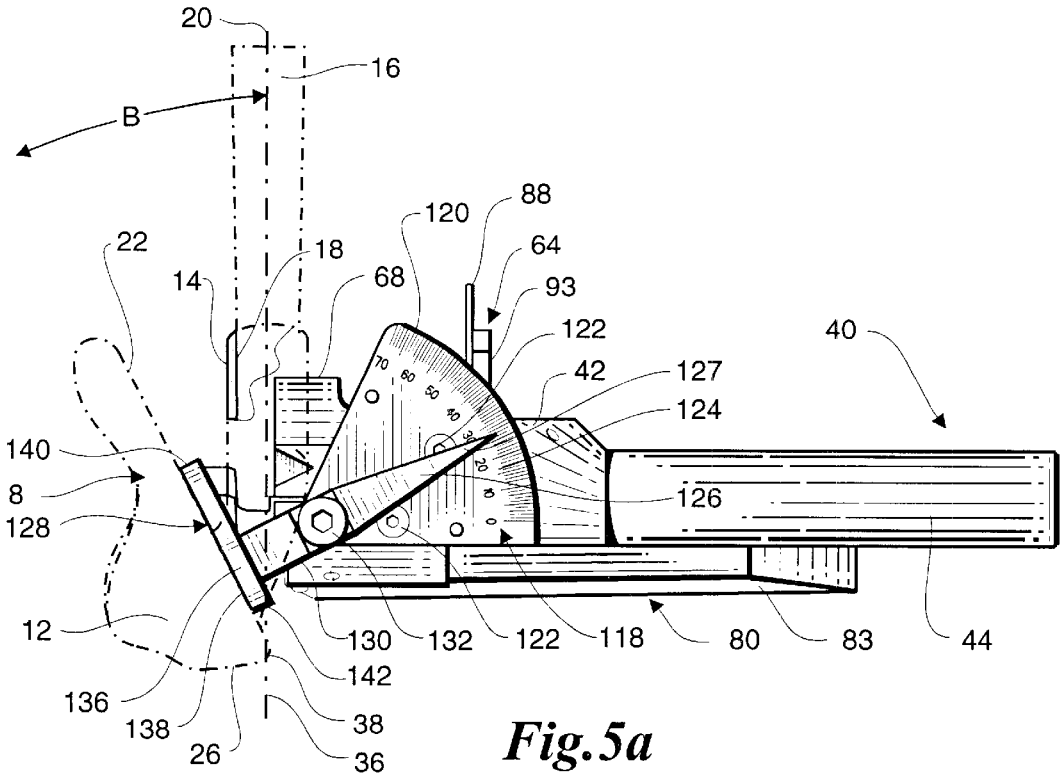
FIG. 5*a* is a side elevational view illustrating the gauge of the present invention attached to a golf club with the gauge providing a visual indication of the golf club loft angle.

To insure a clear understanding of the present invention, a brief description of the various parts of a golf club will now be presented. FIGS. 5*a,* 5*b,* 6*a* and 6*b* illustrate in broken lines typical golf clubs which are indicated generally by the reference numerals 8, 10, 9 and 11, respectively. The golf clubs 8, 9, 10 and 11 each include a head 12 having a hosel 14 with a bore 18 in which a portion of a shaft 16 is mounted. The shaft 16 has a shaft axis 20 and since the hosel 14 is coaxial with the shaft 16, the hosel 14 extends along the shaft axis 20. The club heads 12 each have a face 22 for striking a golf ball (not shown) and a plurality of grooves 24 are formed in the face 22 as is customary. Each of the club heads 12 also includes a sole 26 which extends between a toe 28 and a heel 30 thereof.

When the golf clubs 8, 9, 10 and 11 are being held by a golfer in the address position in preparation for striking a golf ball, an imaginary line 32 that is tangent to a center point 27 on the sole 26 will normally be in parallel contiguous engagement with the ground 34. Angle A, shown in FIG. 6*a,* between the imaginary line 32 and the shaft axis 20 of the golf club is known as the "lie angle" of a golf club.

Further, when the golf clubs 8, 9, 10 and 11 are in the address position, the shaft axis 20 will be contained in an imaginary plane 36, which extends vertically from proximate the bottom edge 38 of the face 22 of the club head 12. Angle B, shown in FIG. 5*a,* between the imaginary plane 36 and the face 22 of the golf club head 12 is known as the "loft angle" of a golf club.

Figure 6A:
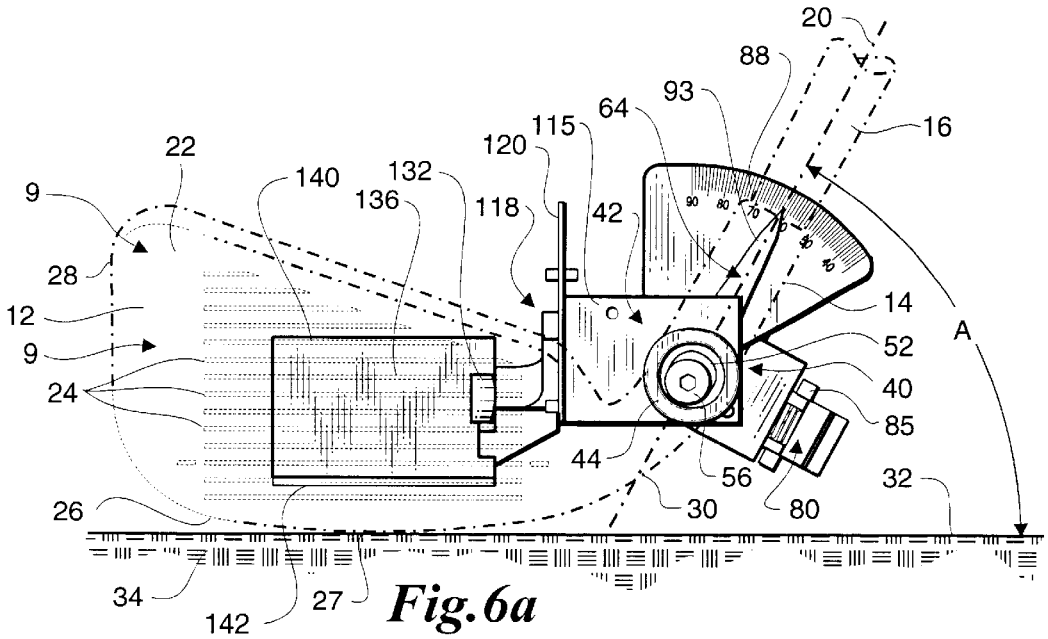
FIG. 6*a* is an end elevational view illustrating the gauge of the present invention attached to a golf club with the gauge providing a visual indication of the golf club lie angle.
Figure 6B:
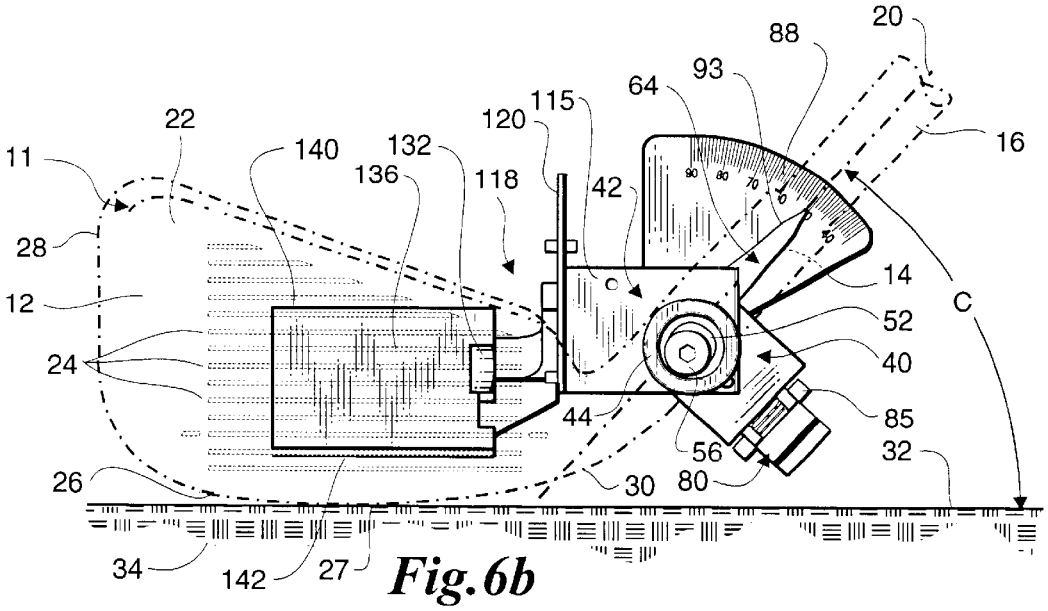
FIG. 6*b* is a view similar to FIG. 6*a* and showing the gauge attached to show the lie angle of a different golf club.

The lie angle of each golf club in a matched set of golf clubs should be the same with the particular lie angle being determined by the physical and swing characteristics of the golfer. Since the physical and swing characteristics are different for each individual golfer, the lie angle will differ accordingly as shown in FIGS. 6*a* and 6*b* wherein the lie angle A for the golf club 9 is larger than the lie angle C for the golf club 11.

Each club in a set of golf clubs will have a different loft angle which is determined by the type of golf shot that is executed by that particular club. This is shown in the examples of FIGS. 5*a* and 5*b* with the club 8 of FIG. 5*a* being a 5-iron having a relatively large loft angle B in comparison to the loft angle D of the club 10 or 1-iron shown in FIG. 5*b*.

Figure 5B:
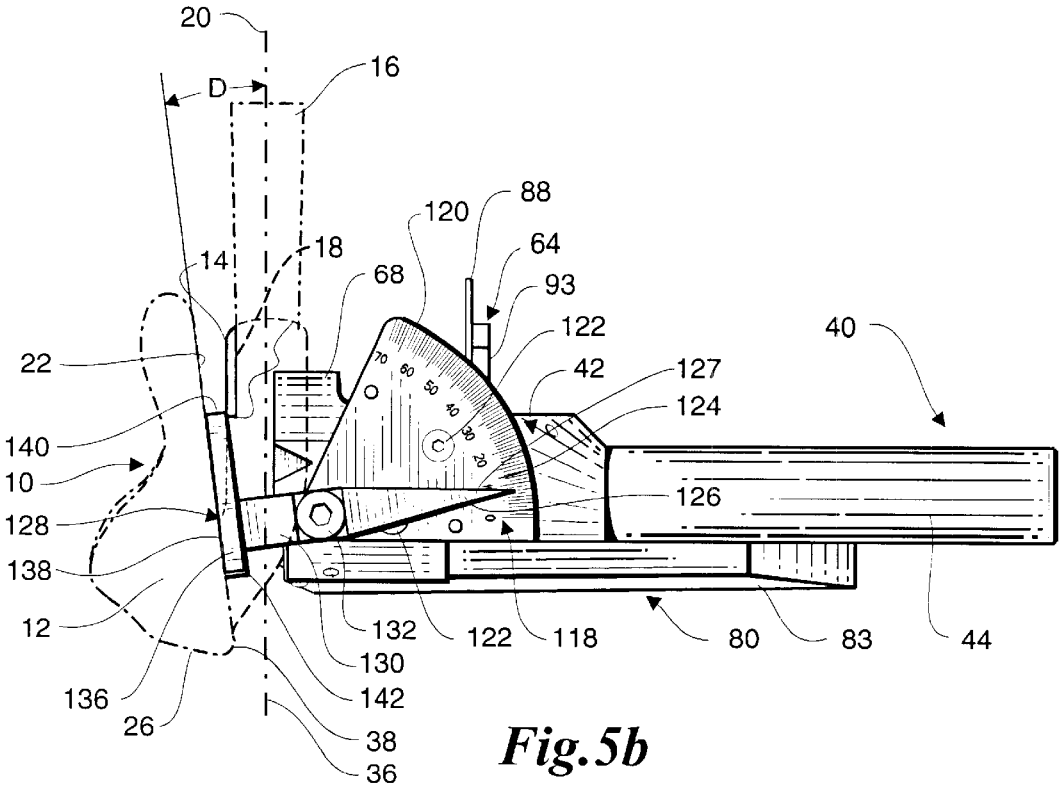
FIG. 5*b* is a view similar to FIG. 5*a* and showing the gauge attached to show the loft angle of a different golf club.

In comparing the drawings, it will be seen that the bottom edge 38 of the club face 22 of the club 8 shown in FIG. 5*a* is in engagement with the imaginary plane 36, whereas there is a space exists between the imaginary plane 36 and the bottom edge 38 of the club 10 shown in FIG. 5*b*. This is known as "off-set" and most sets of golf clubs have such a feature and the amount of off-set will vary with each club in a set.

Figure 1:
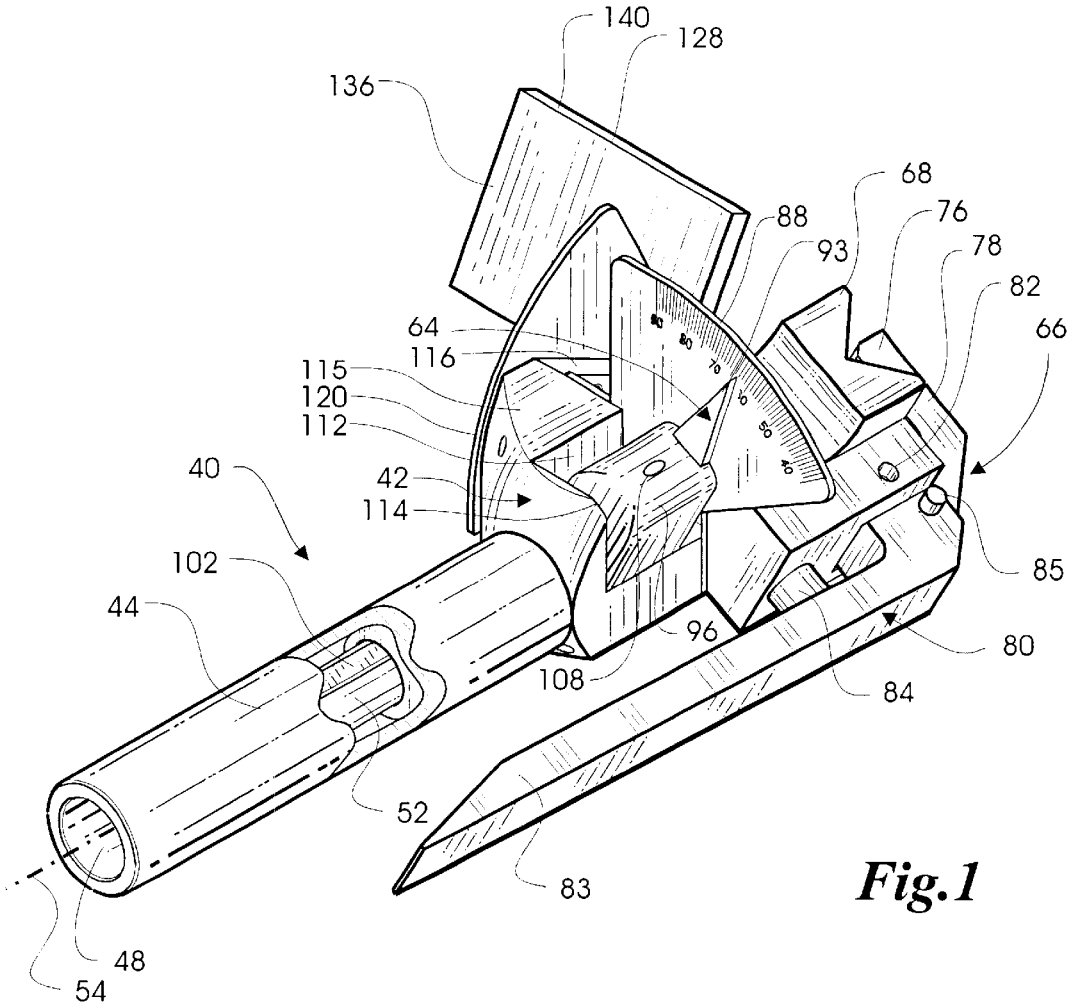
FIG. 1 is a perspective view of a loft and lie gauge according to the present invention.
Figure 2:
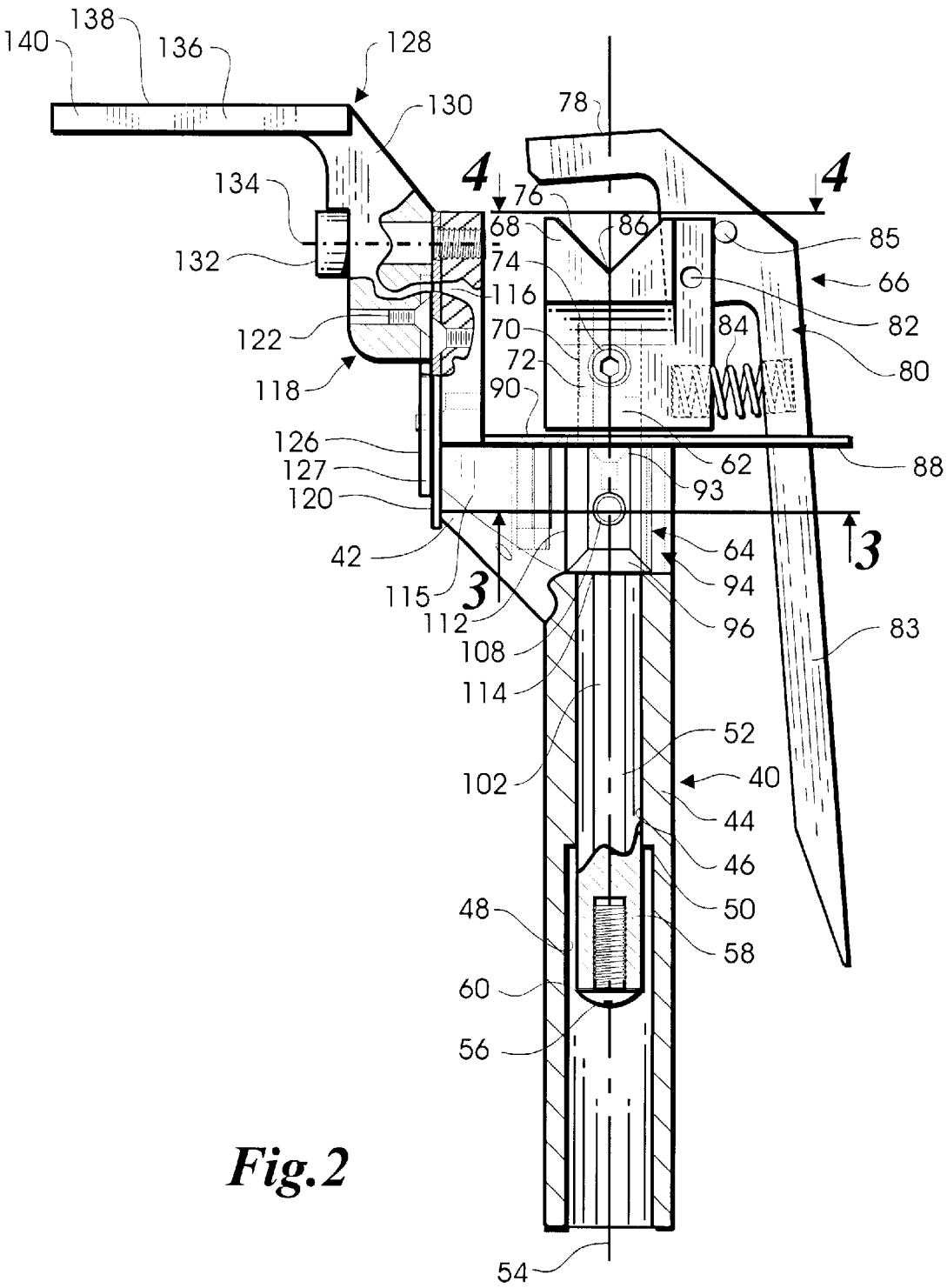
FIG. 2 is an enlarged plan view of the gauge of the present invention which is partially broken away to show the various features thereof.

As seen in FIGS. 1 and 2, a loft and lie gauge of the present invention is indicated generally by the reference numeral 40. The gauge 40 includes a body 42 formed with an elongated tubular handle 44 extending therefrom with the handle 44 defining a bore 46 and having a counterbore 48 which provides a shoulder 50 in the bore 46. A cylindrical rod 52 is mounted in the bore 46 for limited rotary movement about rod axis 54. In addition to rotary movement, the rod 52 is axially movable within the bore 46. A stop screw 56 is eccentrically mounted in the outer end 58 of the rod 52 so that part of the head 60 of the stop screw 56 will engage the shoulder 50 and thereby limit the relative axial movement of the rod 52.

Inner end 62 of the rod 52 extends through a first indicia assembly 64 as will be described in detail, and has a manually operable clamp 66 mounted thereon. The clamp 66 includes a fixed jaw 68 having a bore 70 formed therein that is coaxial with the bore 46. The inner end 62 of the rod 52 is mounted in the bore 70. A flat 72 is formed on the inner end 62 of the rod 52, and a set screw 74 is threadably carried in the fixed jaw 68 for engaging the flat 72 thereby securing the fixed jaw 68, and the entire clamp 66, to the rod 52. The fixed jaw 68 has a V-block 76 machined or otherwise formed in an extension thereof which interacts with a movable jaw 78 to clamp the gauge 40 to the hosel 14 of the golf club to be measured. The movable jaw 78 is formed on one end of a lever 80 that is pivotally attached to the fixed jaw 68 by means of a suitable pivot pin 82. The lever 80 has a hand grip portion 83 that extends in the general direction of the handle 44 of the gauge body 42 and is movable toward and away from the handle 44 to open and close the jaws 68 and 78. A spring 84 has one end mounted in a suitable blind bore formed in the fixed jaw 68 and its other end mounted in a similar blind bore formed in the lever 80. In this manner, the spring 84 biases the lever 80 in a direction to move the movable jaw 78 toward the fixed jaw 68 to close the clamp 66. Movement of the lever 80 is limited by a suitable stop pin 85 carried by the lever 80 which moves with the lever 80 into engagement with the fixed jaw 68.

Figure 4:
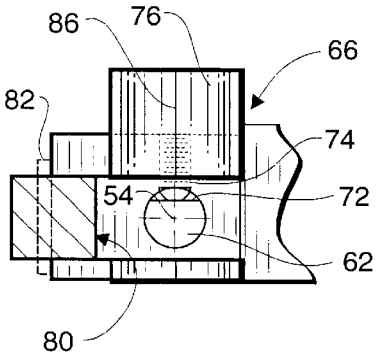
FIG. 4 is a sectional view taken along the line 4—4 of FIG. 2.

As seen best in FIG. 4, the V-block 76 has a V shape with the bottom of the V shape forming a straight line 86 which is perpendicular to the rod axis 54. The V-block line 86 will be in parallel alignment with the shaft axis 20 of the golf club to be measured when the gauge 40 is attached to the hosel 14 in the manner previously described. With the gauge 40 attached to a golf club, the rod 52 and its axis 54 will extend normally to the shaft 16 of the golf club and the rod 52 will be held in a fixed position relative thereto. Thus, the handle 44 and the gauge body 42 are rotatably and axially movable on the rod 52 for reasons that will become clear as this description continues.

Figure 3:
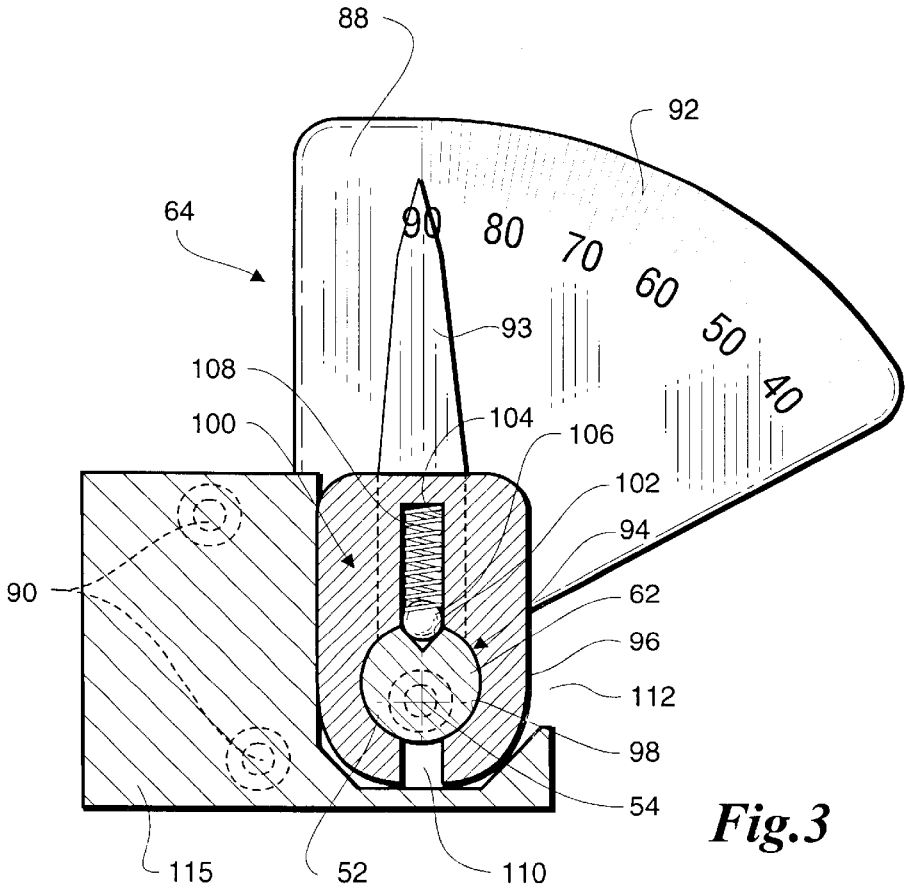
FIG. 3 is an enlarged fragmentary sectional view taken along the line 3—3 of FIG. 2.

The first indicia assembly 64 includes an indicator plate 88 that is fixedly carried on the gauge body 42 such as with suitable screws 90. The indicator plate 88 is provided with an arcuate scale 92 which interacts with an arm 93 of a pointer mechanism 94 to provide a visual indication of the angle of rotation of the gauge body 42 about the axis 54 of the rod 52. As seen in FIG. 3, the pointer mechanism 94 has an enlarged base portion 96 with a first bore 98 formed therethrough in which the rod 52 is disposed. The rod 52 and the pointer mechanism 94 are provided with cooperative elements of a detent mechanism 100 that allows sliding movement of the pointer mechanism 94 on the rod 52 while preventing rotary movement of the pointer mechanism 94 relative to the rod 52. The elements of the detent mechanism 100 are in the form of a V-shaped groove 102 formed in the peripheral surface of the rod 52 so as to extend axially along a portion of the length of the rod 52. A second bore 104 in the preferred form of a blind bore is formed in the pointer mechanism 94 so as to be perpendicular to the first bore 98 and open into that bore 98. A detent ball 106 and a spring 108 are mounted in the blind bore 104 with the ball 106 being biased by the spring 108 into the V-shaped groove 102 provided in the rod 52.

A relatively small diameter hole 110 is formed in the enlarged base portion 96 of the pointer mechanism 94 so as to be in alignment with the blind bore 104 formed therein. That hole 110 is used during assembly of the gauge 40 to mount the pointer mechanism 94 on the rod 52. A suitable tool (not shown) is inserted into the hole 110 and passed through the bore 98 to push the ball 106 into a retracted position within the blind bore 104 to allow the rod 52 to be inserted into the bore 98 of the pointer mechanism 94.

Figure 3A:
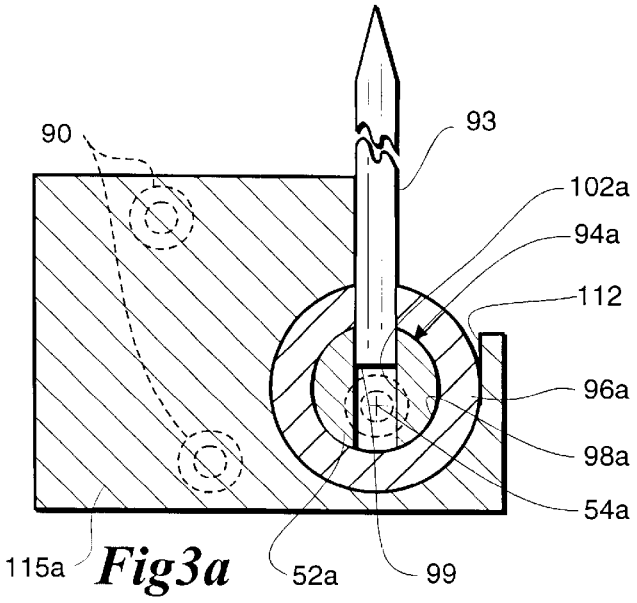
FIG. 3*a* is a sectional view similar to FIG. 3 and showing a modification of the gauge of the present invention.

A modified form of means for mounting a pointer mechanism 94*a* on a rod 52*a* is shown in FIG. 3*a*. In this second embodiment, the rod 52*a* is formed with a U-shaped groove 102*a* that provides a keyway which extends along a portion of the length of the rod 52*a* in the same manner previously described with regard to the V-shaped groove 102 of the first embodiment. The pointer mechanism 94*a* is provided with a bore 98*a* and a key 99 extends from the enlarged base portion 96*a* of the pointer mechanism 94*a* radially into the keyway 102*a* of the rod 52*a*. It will be appreciated that the key 99 and keyway 102*a* arrangement of this embodiment allows the gauge body 42 to move axially on the rod 52 while fixedly mounting the pointer mechanism 94*a* against rotation about the rod axis 54.

The pointer mechanism 94 is mounted in a notched section 112 of the gauge body 42 and is held therein to move axially with the body 42 along the rod 52 by the indicator plate 88 and a shoulder 114 formed in the notched section 112. The notched section 112 is open as seen best in FIG. 1 to allow the gauge body 42 to rotate about the rod axis 54.

The arm 93 of the pointer mechanism 94 is positioned so as to be in parallel alignment with the V-block line 86 of the fixed jaw 68 of the clamp 66. Since the V-block line 86 is in parallel alignment with the shaft axis 20 of the golf club to be measured when the gauge 40 is attached thereto, the arm 93 of the pointer mechanism 94 will also be in parallel alignment with the shaft axis 20 of the golf club. The reason for these parallel alignment relationships will be described in detail.

As seen best in FIGS. 1, 2 and 5*a*, the gauge body 42 is formed with a laterally extending portion 115 and a flange 116 which is disposed so as to be spaced from and parallel with the rod axis 54. A second indicia assembly 118 includes an indicator plate 120 which is mounted on the outwardly facing surface of the flange 116 such as with screws 122. The indicator plate 120 is provided with an arcuate scale 124 which interacts with an arm 126 of a golf club face engaging member 128 to provide a visual indication of the loft angle of a golf club to be measured. The arm 126 is pivotally movable in a plane that is spaced from and parallel to the axis 54 of the rod 52, and a pointed end 127 of the arm 126 overlays the indicator plate 120. The arm 126 and has an opposite end 130. The face engaging member 128 is pivotally mounted intermediate the ends 127 and 130 of the arm 126 to the flange 116 by a suitable screw 132 which defines a pivot axis 134 for the club face engaging member 128. A plate 136 extends normally from the opposite end 130 of the arm 126 and has a bearing surface 138 and a spaced apart pair of parallel edges 140 and 142 with the bearing surface 138 and the parallel edges 140 and 142 being perpendicular to the axis 54 of the rod 52.

To measure the loft and lie angles of a golf club, the gauge 40 is clamped to the hosel 14 of golf club 8, 9, 10 or 11. When attached, the rod 52 will extend in a normal attitude to the golf club hosel 14 and thus is normal with respect to the shaft axis 20 of the club being measured, and is held fast against rotation. Also, the arm 93 of the first indicia assembly 64 will be held fast in parallel alignment with the shaft axis 20. With the rod 52 being held fast, the gauge body 42 is free to move axially and rotatably about the axis 54 of the rod 52. Such movements, along with rotary movements of the entire gauge 40 about the shaft axis 20 of the golf club, are manually accomplished to move the laterally extending portion 115 of the body 42 and the pivot axis 134 of the face engaging member 128 into parallel alignment with the tangent line 32 (FIG. 6*a*) of the golf club. Since the laterally extending portion 115 of the body 42 and the pivot axis 134 of the face engaging member 128 are spaced from the golf club, movement of the laterally extending portion 115 and the pivot axis 134 into precise parallel alignment with the tangent line 32 may be difficult but not impossible. Therefore, in addition to providing a visual indication of the loft angle of the club being measured, the face engaging member 128 is used to achieve the precision alignment required to give an accurate visual indication of the lie angle of the golf club. This is accomplished by pivotally moving the face engaging member 128 so as to bring the bearing surface 138 of the plate 136 into contiguous engagement with the face 22 of the club head and rotatably moving the body 42 about the rod axis 54 to bring the parallel edges 140 and 142 into parallel alignment with the grooves 24 formed in the face 22 of the club head.

Since the rod 52 and the handle 44 of the gauge body 42 are normal to the shaft axis 20 of the golf club, they will also be normal to the imaginary plane 36 which contains the shaft axis 20 and is in parallel alignment with the bottom edge 38 of the club face 22 when the plate 136 is in contiguous engagement with the face 22 of the club head. When the rod 52 and the handle 44 of the body 42 are normal to the imaginary plane 36, the pivot axis 134 about which the face engaging member 128 is movable will also be parallel to the imaginary plane 36. Thus pivotable movement of the face engaging member 128 to bring the plate 136 into contiguous engagement with the club face 22 will move the arm 126 relative to the indicator plate 120 to provide a visual indication of the golf club loft angle by showing the angular disposition of the golf club face 22 relative to the imaginary plane 36. Two examples of different loft angles B and D being measured and indicated by the gauge 40 are shown in FIGS. 5*a* and 5*b,* respectively.

Rotation of the gauge body 42 about the rod 52 to bring the edges 140 and 142 of plate 136 into parallel alignment with the grooves 24 of the golf club face 22 will move the indicator plate 88 relative to the arm 93 which is being held by the clamp 66 in parallel alignment with the shaft axis 20 of the golf club. Since the grooves 24 are parallel to the imaginary tangent line 32 of the golf club being measured, the lie angle, that is the angle between the imaginary tangent line 32 and the golf club shaft axis 20, will be indicated by the first indicia assembly 64. Two examples of different lie angles A and C being measured and indicated by the gauge 40 are shown in FIGS. 6*a* and 6*b,* respectively.

Figure 7:
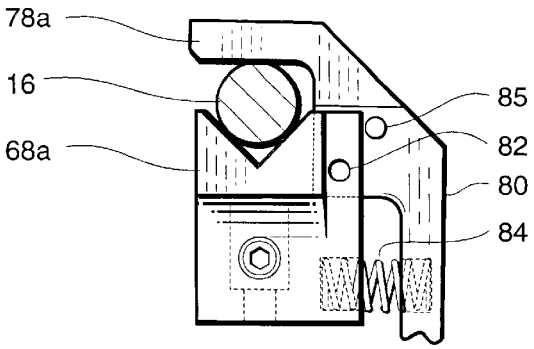
FIG. 7 is a fragmentary sectional view showing a modified form of the gauge of the present invention attached to the shaft of a golf club.

It will be appreciated that golf clubs made by some manufacturers have little or no hosels and attachment of the gauge 40 in the manner hereinbefore described to such clubs would be difficult if not impossible. Therefore it will be understood that the gauge 40 can be attached directly to the golf club shaft 16 as shown in FIG. 7, by configuring a fixed jaw 68*a* and a movable jaw 78*a* to grip the smaller diameter of the golf club shaft 16.

What is claimed is:

1. A gauge for measuring loft and lie angles of a golf club, the golf club including a shaft having an axis and a club head with a sole, an imaginary line tangent to a center point of the sole, an imaginary plane containing the shaft axis and disposed in parallel relationship to said imaginary line, and the club head having a face disposed at an angle relative to said imaginary plane, said gauge comprising:

a rod having an inner end and an outer end;

a clamp mounted on the inner end of said rod for attachment to the golf club with said rod being normal to the shaft axis, said clamp being rotatable about the shaft axis to move said rod into a perpendicular attitude relative to said imaginary plane;

a body defining a bore in which said rod is disposed, said body being axially and rotatably movable on said rod and having a laterally extending portion;

a face engaging member mounted on said body and being movable therewith on said rod, said face engaging member also being pivotally movable relative to said body so that the laterally extending portion of said body may be positioned in parallel alignment with said imaginary line, said face engaging member engaging the face of the golf club when said rod is attached to the golf club in a perpendicular attitude relative to the imaginary plane;

a first indicia assembly for displaying the lie angle of the golf club, said first indicia assembly being mounted on said body for providing a visual indication of the position of said body relative to the shaft axis; and a second indicia assembly for displaying the loft angle of the golf club, said second indicia assembly being mounted on said face engaging member to provide a visual indication of the position of said face engaging member relative to said imaginary plane when said face engaging member is in engagement with the face of the golf club.

2. A gauge as defined in claim 1, wherein said clamp comprises:

a fixed jaw mounted on the inner end of said rod;

a lever pivotally mounted on said fixed jaw and including a movable jaw, said lever being operable to move the movable jaw toward said fixed jaw into a closed position and away from said fixed jaw into an open position; and means in bearing engagement with said fixed jaw and said lever to bias said movable jaw into the closed position.

3. A gauge as defined in claim 2, wherein said clamp further comprises said fixed jaw being in the form of a V-block having a V shape with a bottom of the V shape defining a straight line that is in parallel alignment with the shaft axis of the golf club when said clamp is attached thereto.

4. A gauge as defined in claim 1, wherein the golf club further includes a plurality of grooves formed in the face thereof and arranged in parallel relationship with said imaginary line, and wherein said face engaging member comprises:

an arm pivotally attached to said body for movement in a plane spaced from and parallel to said rod; and a plate extending normally from said arm, said plate having a bearing surface for movement into engagement with the face of the golf club and having an edge for movement into parallel alignment with the grooves on the face of the golf club.

5. A gauge as defined in claim 1, wherein said first indicia assembly further comprises:

an indicator plate mounted on said body for movement therewith in a plane normal to said rod;

a pointer mechanism having an arm and a bore;

means for mounting said pointer mechanism on said rod so that said rod is axially slidable in the bore thereof and fixedly held against rotary movement about said rod so that the pointed end of said pointer mechanism extends fixedly and radially from said rod in overlaying relationship with said indicator plate; and an arcuate scale on said indicator plate for displaying a visual indication of the lie angle of the golf club by showing the angle of rotation of said indicator plate relative to the arm of said pointer mechanism.

6. A gauge as defined in claim 1, wherein said first indicia assembly further comprises:

an indicator plate mounted on said body for movement therewith in a plane normal to said rod;

a pointer mechanism mounted on said rod and having an arm in overlaying relationship with said indicator plate, said pointer mechanism having a bore through which said rod axially extends;

cooperating elements of a detent mechanism formed on said pointer mechanism and on said rod to allow said rod to move axially through the bore of said pointer mechanism while holding said pointer mechanism against rotation about said rod so that the arm extends radially from said rod in fixed parallel alignment with the shaft axis of the golf club when said rod is attached thereto; and an arcuate scale on said indicator plate for providing a visual indication the lie angle of the golf club by displaying the rotated position of said indicator plate relative to the arm of said pointer mechanism.

7. A gauge as defined in claim 6, wherein said cooperating elements of a detent mechanism further comprise:

said pointer mechanism having a second bore formed therein and disposed in perpendicular relationship and opening into the bore in which said rod is axially disposed;

said rod having an elongated groove formed in the inner end thereof and extending along a portion of the length of said rod;

a detent ball in said second bore; and a spring in the second bore for biasing said ball into the elongated groove formed in said rod.

8. A gauge as defined in claim 1, wherein said second indicia assembly further comprises:

an indicator plate mounted on said body;

said face engaging member having an arm attached to said body for pivotable movement with said face engaging member, said arm being movable in a plane spaced from and parallel with said rod; and an arcuate scale on said indicator plate for displaying a visual indication of the loft angle of the golf club by showing the pivoted position of the arm of said face engaging member relative to said indicator plate.

9. A gauge as defined in claim 1, further comprising a handle extending from said body, and wherein said bore in which said rod is disposed extends into said handle.

10. A gauge as defined in claim 9, further comprising a shoulder in said bore, and stop means on the outer end of said rod for engaging said shoulder for limiting axial movement of said rod.

* * * * *